US009334731B2

(12) United States Patent
Jonker et al.

(10) Patent No.: US 9,334,731 B2
(45) **Date of Patent: *May 10, 2016**

(54) PICK TOOL AND ASSEMBLY COMPRISING SAME

(71) Applicants: ELEMENT SIX ABRASIVES S.A., Luxembourg (LU); ELEMENT SIX GMBH, Burghaun (DE)

(72) Inventors: Cornelis Roelof Jonker, Springs (ZA); Robert Fries, Springs (ZA); Frank Friedrich Lachmann, Late of Burghaun (DE); Bernd Heinrich Ries, Burghaun (DE)

(73) Assignees: Element Six Abrasives S.A., Luxembourg (LU); Element Six GmbH, Burghaun (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/372,761

(22) PCT Filed: Jan. 11, 2013

(86) PCT No.: PCT/EP2013/050488

§ 371 (c)(1),
(2) Date: Jul. 17, 2014

(87) PCT Pub. No.: WO2013/110510

PCT Pub. Date: Aug. 1, 2013

(65) Prior Publication Data

US 2015/0035342 A1 Feb. 5, 2015

Related U.S. Application Data

(60) Provisional application No. 61/590,033, filed on Jan. 24, 2012.

(30) Foreign Application Priority Data

Jan. 24, 2012 (GB) ..... 1201120.1

(51) Int. Cl.
*E21C 35/18* (2006.01)
*E21C 35/183* (2006.01)

(Continued)

(52) U.S. Cl.
CPC ..... *E21C 35/183* (2013.01); *B28D 1/186* (2013.01); *E01C 23/088* (2013.01); *E21C 25/10* (2013.01)

(58) Field of Classification Search
CPC ..... E21C 35/183
See application file for complete search history.

(56) References Cited

U.S. PATENT DOCUMENTS 3,830,321 A * 8/1974 McKenry ..... E21C 35/183 299/111
5,011,229 A 4/1991 O'Neill et al.

(Continued)

FOREIGN PATENT DOCUMENTS

| | | | |
|---|---|---|---|
| CN | 101523014 | A | 9/2009 |
| GB | 2488408 | A | 8/2012 |
| WO | 0129375 | A2 | 4/2001 |
| WO | 2008105915 | A2 | 9/2008 |

(Continued)

OTHER PUBLICATIONS

United Kingdom Application No. 1201120.1, Combined Search and Examination Report mailed on Mar. 13, 2012, 6 pages.
United Kingdom Application No. 1300487.4, Combined Search and Examination Report mailed on Mar. 28, 2013, 7 pages.

(Continued)

*Primary Examiner* — John Kreck
(74) *Attorney, Agent, or Firm* — Dean W. Russell; Clark F. Weight; Kilpatrick Townsend & Stockton LLP

(57) ABSTRACT

A pick tool comprising a super-hard strike tip, a base and a unitary cemented carbide support body comprising a head portion including an overhang portion, and an insertion shaft extending from the head portion, a surface of the overhang portion extending laterally from the insertion shaft; the strike tip is attached to the head portion of the support body and the base is provided with a bore into which the insertion shaft is shrink fitted; the base has an external surface adjacent the bore and overhang portion of the head portion is configured to extend over at least an area of the external surface operative to shield the area from wear when in use.

7 Claims, 4 Drawing Sheets

(51) Int. Cl.

| | |
|---|---|
| ***E01C 23/088*** | (2006.01) |
| ***B28D 1/18*** | (2006.01) |
| ***E21C 25/10*** | (2006.01) |

(56) References Cited

U.S. PATENT DOCUMENTS

| | | | | |
|---|---|---|---|---|
| 5,605,382 | A | 2/1997 | Massa | |
| 6,341,823 | B1 | 1/2002 | Sollami | |
| 9,028,009 | B2 * | 5/2015 | Heiderich | E21C 35/183 299/105 |
| 2008/0035383 | A1 | 2/2008 | Hall et al. | |
| 2009/0284069 | A1 | 11/2009 | Watson et al. | |
| 2011/0089747 | A1 | 4/2011 | Helsel et al. | |
| 2011/0175430 | A1 | 7/2011 | Heiderich et al. | |

FOREIGN PATENT DOCUMENTS

| | | | |
|---|---|---|---|
| WO | 2011004030 | A2 | 1/2011 |
| WO | 2011089117 | A2 | 7/2011 |

OTHER PUBLICATIONS

International Application No. PCT/EP2013/050488, International Search Report and Written Opinion mailed on Feb. 17, 2014, 11 pages.

United Kingdom Application No. 1300487.4, Examination Report mailed on Jan. 19, 2015, 2 pages.

United Kingdom Application No. 1300487.4, Notification of Grant mailed on May 12, 2015, 2 pages.

* cited by examiner

PICK TOOL AND ASSEMBLY COMPRISING SAME

CROSS REFERENCE TO RELATED APPLICATIONS

This application is the U.S. national phase of International Application No. PCT/EP2013/050488 filed on Jan. 11, 2013, and published in English on Aug. 1, 2013 as International Publication No. WO 2013/110510 A2, which application claims priority to Great Britain Patent Application No. 1201120.1 filed on Jan. 24, 2012 and U.S. Provisional Application No. 61/590,033 filed on Jan. 24, 2012, the contents of both of which are incorporated herein by reference.

This disclosure relates generally to pick tools comprising super-hard strike tips and to assemblies comprising same.

International patent application publication number WO/2011/089117 discloses a pick tool comprising an insert mounted in a steel holder, the insert comprising a super-hard tip joined to a cemented carbide support body at an end of the support body, the support body comprising an insertion shaft. The steel holder has a bore configured to accommodate the insertion shaft and comprises a shank for mounting the steel holder onto a tool carrier. The insertion shaft is shrink-fitted within the bore.

There is a need for a super-hard pick tool having high resistance to wear.

Viewed from a first aspect there is provided a pick tool comprising a super-hard strike tip, a base and a unitary cemented carbide support body comprising a head portion including an overhang portion, and an insertion shaft extending from the head portion; the strike tip is attached to the head portion and the base is provided with a bore into which the insertion shaft is shrink fitted; the base has an external surface adjacent the bore and overhang portion is configured to extend over at least an area of the external surface operative to shield the area from wear when in use. As used herein, a unitary support body is one in which the head portion, the overhang portion and insertion shaft are integrally formed as a single component (i.e. none of these portions is joined to any of the other portions by means of brazing, for example).

The overhang portion may extend radially over the external surface a distance of more than 5 per cent of the mean diameter of the bore at the proximate end.

The insertion shaft may be generally columnar or cylindrical in shape and the head portion of the support body may be generally frusto-conical. The insertion shaft may be relatively elongate, extending relatively deeply into the base. The insertion shaft is thus likely to providing a wear-resistant core capable of remaining in working condition and sufficiently well retained by the base even once the forward-facing volume of the base has been substantially worn away in use. Such relatively long insertion shafts are likely to be more readily shrink-fitted into the bore rather than press-fitted, the latter likely requiring a substantially greater force when the insertion shaft is relatively long. In some example arrangements, the volume of the support body may be at least about 15 $cm^3$ or at least about 25 $cm^3$. The length of the insertion shaft may be at least about 20 mm, at least about 25 mm. The combination of a protective overhang portion and a relatively large insertion shaft, which is shrink-fitted into the bore, is likely to provide substantially enhanced protection against the effects of abrasive wear in use.

The base may be provided with a through-hole extending from the bore (the bottom end of the bore) to an opposite outer end of the base, the through-hole providing a communication channel between the bore and the external environment. The through hole may allow gas to escape from the bore and facilitate turning of the holder in the process of shrink fitting the insertion shaft, as well as facilitate removal of the insertion shaft for re-use.

In an example arrangement, there is provided a pick tool comprising a super-hard strike tip, a support body comprising an insertion shaft, and a base; the strike tip joined to a proximate end of the support body, the base provided with a bore for receiving the insertion shaft and having an external surface adjacent a proximate end of the bore; the insertion shaft being shrink fitted into the bore and the support body comprising an overhang portion configured to extend over at least an area of the external surface operative to shield the area from wear when in use; the overhang portion extending radially over the external surface a distance of more than 5 per cent of the mean diameter of the bore at the proximate end.

Various combinations and arrangements are envisaged by the disclosure, of which the following are non-limiting and non-exhaustive examples.

The pick tool may be for degrading road paving or rock formations operations, for example, and the pick tool may be mounted onto a carrier such as a drum or a fixture joined to a drum for a road milling or mining apparatus.

The super-hard material may comprise or consist of synthetic or natural diamond, polycrystalline diamond (PCD) material, cubic boron nitride (cBN), polycrystalline cubic boron nitride (PCBN) material and or silicon carbide bonded diamond material, for example.

The proximate end of the support body may have a generally frusto-conical shape, in which a conical circumferential side surface extends away from an interface boundary between the support body and the strike tip. The largest lateral diameter through the support body may be substantially greater than the diameter of the bore to provide the overhang portion extending over an area of the external surface adjacent the proximate end of the bore. A surface of the support body may abut the external surface or may be spaced apart from it. The external surface may surround the bore circumferentially and extend generally laterally away from the bore and or at least part of the external surface may be canted at an angle to the lateral plane (a longitudinal axis being defined by the insertion shaft). The overhang portion may have the form of a skirt surrounding a central volume of the support body.

In some example arrangements, the strike tip may comprise a strike structure joined to a substrate at an interface boundary (between the strike structure and the substrate), the strike structure comprising super-hard material and the substrate comprising carbide material; the strike structure having a strike end opposite the interface boundary, the strike end including a rounded apex having a radius of curvature in a longitudinal plane of greater than 3.176, at least 3.2 mm or at least 3.3 mm and at most about 6 mm, at most about 5 mm or at most about 4 mm (the longitudinal plane passing through the apex and the interface boundary opposite the apex).

The support body may comprise cemented tungsten carbide, ceramic material, silicon carbide cemented diamond material or super-hard material, and the base may comprise steel. The support material may have Rockwell hardness of at least about 90 HRa and transverse rupture strength of at least about 2,500 MPa. For example, the support body may comprise or consist of cemented tungsten carbide material having magnetic saturation of at least about 7 $G.cm^3/g$ and at most about 11 $G.cm^3/g$ and coercivity of at least about 9 kA/m and at most about 14 kA/m. The support body may comprise or consist of cemented carbide material, which may comprise tungsten carbide grains and at least about 5 weight per cent and at most about 10 weight per cent or at most about 8 weight per cent binder material, which may comprise cobalt. The tungsten carbide grains may have mean size of at least about 1 micron or at least about 2 microns, and or at most about 6 microns, at most about 5 microns or at most about 3 microns.

Viewed from a second aspect there is provided an assembly comprising a pick tool according to this disclosure and a fixture attached or attachable to a drum for road milling or mining, in which the fixture and pick tool are cooperatively configured to be capable of being coupled in such a way that the pick tool cannot rotate with respect to the fixture. In other words, the pick tool can only be non-rotatably coupled to the fixture when assembled as for use.

Disclosed pick tools may have the aspect of enhanced wear resistance and extended working life. In particular, the rate of abrasive wear of the steel base is likely to be reduced due to the protective effect of the configuration of the support body over part of an external surface of the base, which may be prone to wear in use. The shrink-fitting of the insertion shaft into the bore enables the support body to comprise relatively harder and more wear resistant grades of cemented carbide material, which are likely to be relatively difficult to join to the base by certain other means, such as brazing. Such grades of carbide are likely to be more effective at protecting the base from wear in use. Disclosed picks may also have the aspect that the volume of the insertion shaft could be reduced owing to the enhanced wear protection of the base arising from the configuration of the support body.

Non-limiting example arrangements to illustrate the present disclosure are described hereafter with reference to the accompanying drawings, of which:

Figure 1:
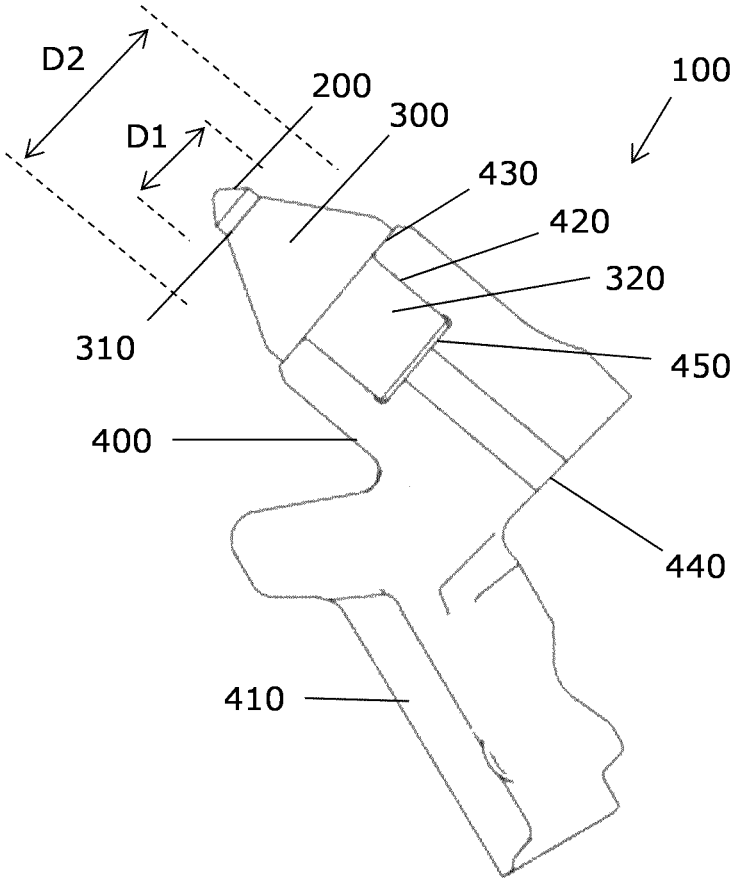
FIG. 1 and FIG. 2 shows schematic partly cut-away side views of example picks.
Figure 2:
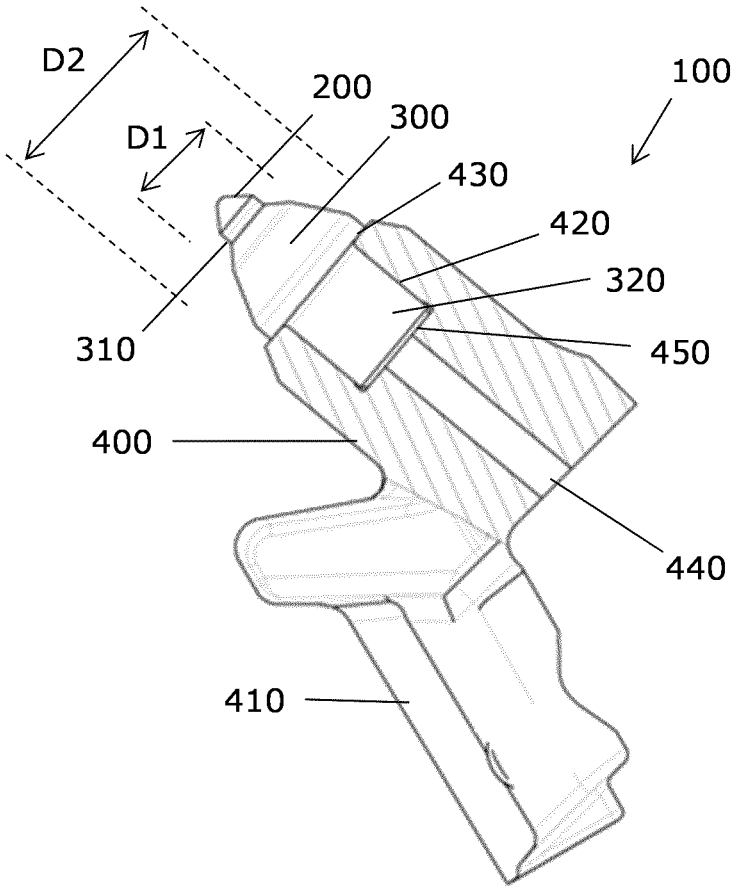

With reference to FIG. 1 and FIG. 2, an example pick tool 100 for road milling or mining comprises a strike tip 200 comprising PCD material, a support body 300 comprising an insertion shaft 320, and a steel base 400. The strike tip 200 is joined to a proximate end surface 310 of the support body 300. The super-hard strike tip 200 comprises a polycrystalline diamond (PCD) strike structure joined to a cemented carbide substrate at an interface boundary between the substrate and the strike structure. The base 400 is provided with a bore 420 for receiving the insertion shaft 320 and has an external surface 430 adjacent a mouth of the bore 420 at a proximate end of the bore 420. The support body 300 comprises an overhang portion being the volume of the support body 300 included between the outer diameter D2 and the diameter D1 of the bore. The overhang portion between D1 and D2 extends over and abuts an area of the external surface 430 to protect the area from wear when in use. The base 400 also comprises a shank 410 for coupling the base 400 to a road milling drum (not shown) and may be provided with a through-hole 440 at a distal end of the bore 420 for removing the support body. The insertion shaft 320 is shrink fitted into the bore 420 and abuts an annular seat 450.

Figure 3:
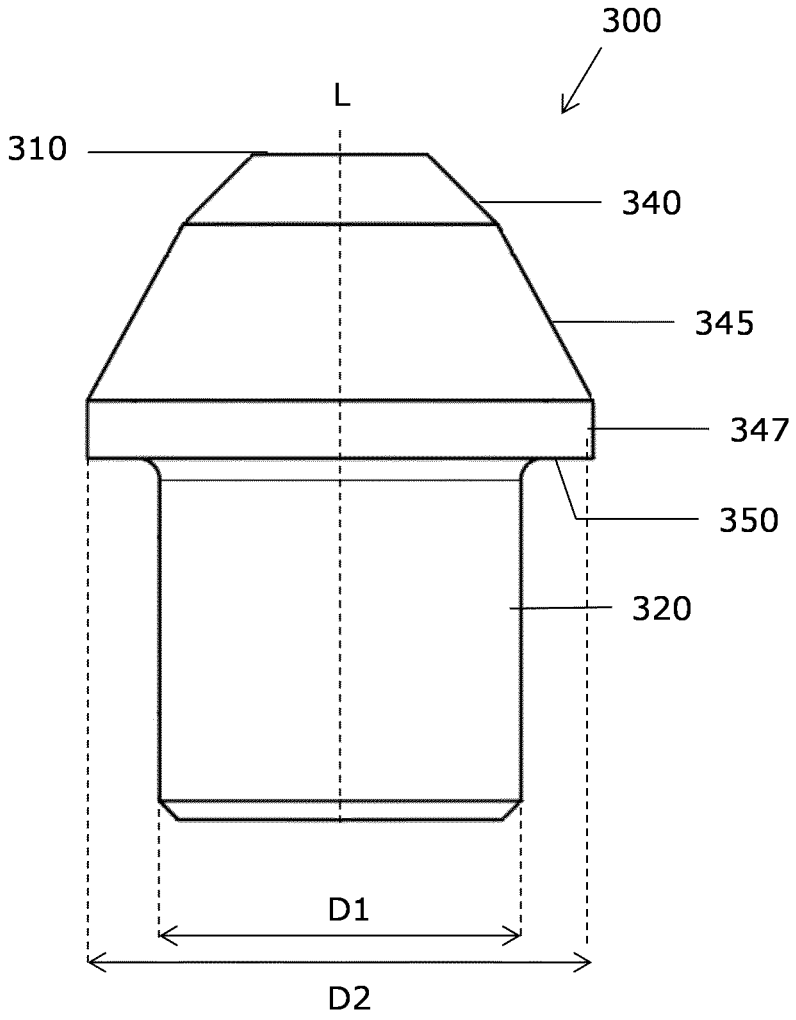
FIG. 3 shows a schematic side view of an example support body for a pick tool.

With reference to FIG. 3. the support body 300 comprises a first conical surface 340 extending from the proximate end surface 310 and a second conical surface 345 extending from the first conical surface 340 to a circumferential peripheral side 347, the first and second conical surfaces 340, 345 being concentric and having different cone angles. The first conical surface defines an included cone angle diametrically through the support body 300 (on a longitudinal plane) of about 90 degrees and the second conical surface 345 defines an included cone angle of about 57.2 degrees. The peripheral side 347 defines the widest diameter D2 of the support body 300, D2 being about 35 mm. The diameter D1 of the insertion shaft 320 is about 25 mm. The overhang portion of the support body 300 included between the diameters D1 and D2 has a circumferential lower surface 350 extending beyond the insertion shaft 320 and having a width of about 5 mm. When assembled in the pick tool 100, the lower annular surface 350 will extend the distance of 5 mm over the external surface 430 of the steel base surrounding the bore 420. The insertion shaft 320 has a length of about 25 mm and the peripheral side 347 has an axial length of about 4 mm. The support body 300 comprises cemented tungsten carbide having Rockwell hardness of about 90.6 HRa, transverse rupture strength of at least about 2,800 MPa, fracture toughness of about 12.7 MPa.$m^{1/2}$, magnetic saturation of about 8.2 G.$cm^3$/g to about 9.5 G.$cm^3$/g and coercivity of about 10.3 kA/m to about 12.2 kA/m.

Figure 4:
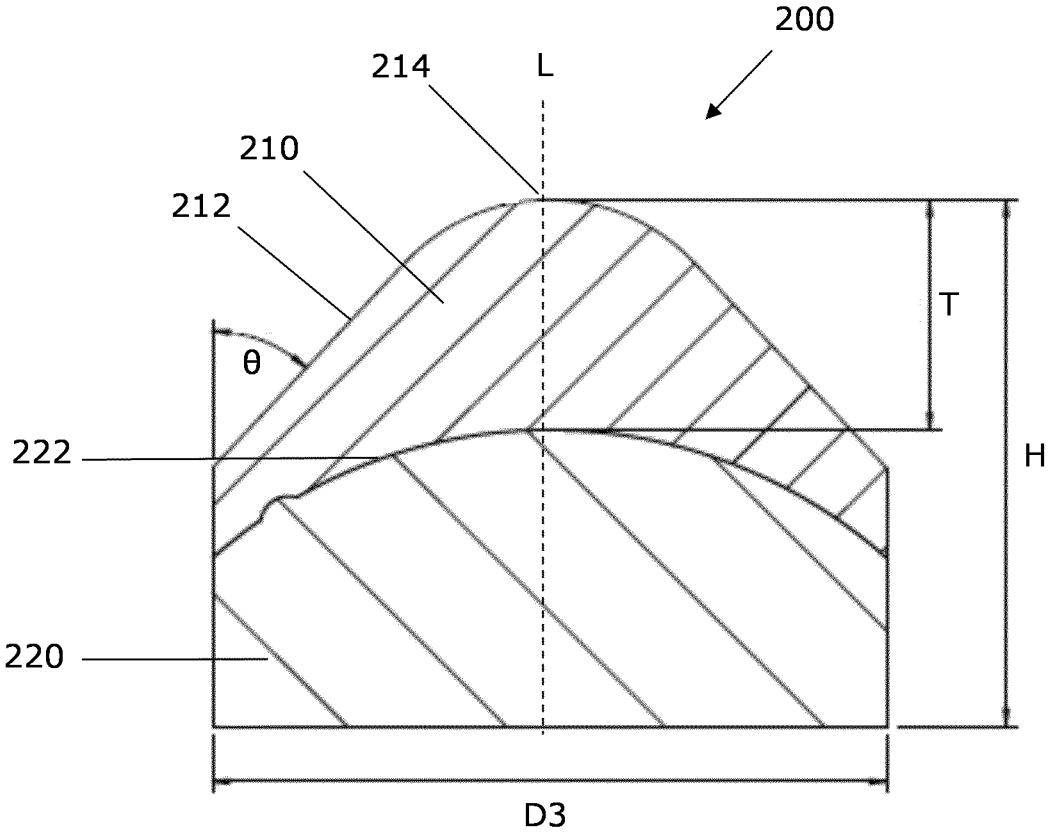
FIG. 4 shows a schematic cross section view of an example strike tip for a pick tool.

With reference to FIG. 4, an example strike tip 200 comprises a strike structure 210 joined to a cemented carbide substrate 220 at an interface boundary 222 between the substrate 220 and the strike structure. In this example, the strike structure 210 comprises PCD material and has a strike end 212 in the general form of a blunted cone including a spherically blunted cone apex 214. The apex 214 has a radius of curvature in a longitudinal plane of about 3.5 mm, the longitudinal plane being parallel to a longitudinal axis L passing through the apex 214 and the interface boundary 222 opposite the apex 214. The conical surface of the strike end 212 is inclined at an angle θ of about 43 degrees with respect to a plane tangent to a peripheral side surface of the strike tip 200. The interface boundary 222 is generally dome-shaped and defined by a spherically convex proximate end of the substrate 220 having a radius of curvature in the longitudinal plane of about 9 mm. The thickness T of the PCD strike structure between the apex 214 and the interface boundary 222 opposite the apex 214 is about 4 mm. The overall height H of the strike tip 100 between the apex 214 and a distal end of the substrate 220 opposite the proximate end defining the boundary 222 is about 9.4 mm. The volume of the PCD strike structure 210 is about 280.7 cubic mm and the volume of the substrate is about 476 cubic mm. In other example arrangements, the volume of the PCD strike structure 210 may be at least 70 per cent and at most 150 per cent of the volume of the substrate 220. The PCD material comprises about 82 weight per cent substantially inter-gown diamond grains and about 18 weight per cent filler material disposed in the interstitial regions between the diamond grains, the filler material comprising cobalt. The diamond grains have a multi-modal size distribution and a mean size of about 20 microns. The substrate 220 comprises cobalt-cemented tungsten carbide material comprising about 92 weight per cent tungsten carbide (WC) grains and about 8 weight per cent cobalt (Co). The magnetic saturation of the cemented carbide material is in the range from about 132 to about 136 in units of 0.1 micro-Tesla times cubic metre per kilogram (μT.$m^3$/kg) or about 10.5 to about 12.8 G.$cm^3$/g, and the magnetic coercivity is in the range from about 7.2 to about 8.8 kA/m or about 90 to about 110 Oe. The hardness of the cemented carbide material is about 88.7 HRa, the transverse rupture strength is about 2,800 MPa, the fracture toughness is about 14.6 MPa and the Young's modulus is about 600 MPa.

In order to reduce stresses, sharp corners at points of contact may be avoided. For example, edges and corners may be radiused or chamfered, and the edge of the bore may be provided with a radius or chamfer to reduce the risk of stress-related cracks arising.

At least a portion of the insertion shaft will be secured within the bore by means of a shrink fit. As used herein, a shrink fit is a kind of interference fit between components achieved by a relative size change in at least one of the components (the shape may also change somewhat). This is usually achieved by heating or cooling one component before assembly and allowing it to return to the ambient temperature after assembly. Shrink-fitting is understood to be contrasted with press-fitting, in which a component is forced into a bore or recess within another component, which may involve generating substantial frictional stress between the components. Shrink-fitting is likely to result in a region (not indicated) of the base adjacent the bore being in a static state of circumferential tensile stress. In some examples of pick tools, a region within the base adjacent the bore may be in a state of circumferential (or hoop) static tensile stress of at least about 300 MPa or at least about 350 MPa, and in some pick tools, the circumferential static tensile stress may be at most about 450 MPa or at most about 500 MPa. As used herein, the static stress state of a tool or element refers to the stress state of the tool or element under static conditions, such as may exist when the tool or element is not in use.

The interference between the insertion shaft and the bore of the base is the difference in size between them, which may be expressed as a percentage of the size. For example, in arrangements where the insertion shaft (and the bore) has a generally circular cross section, the interference may be expressed as the difference in diameter as a percentage of the diameter. The dimension between the insertion shank and the bore would be expected to be selected depending at least on the diameter of the insertion shank, and may be at least about 0.002 per cent of the diameter of the insertion shank. In one example, the diameter of the insertion shank is about 2.5 cm and the interference between the insertion shank and the bore is about 0.08 per cent of the diameter of the insertion shank. The interference between the insertion shank and the bore may be at most about 0.3 per cent of the diameter of the diameter of the insertion shank. If the interference is too great, the elastic limit of the steel material of the holder may be exceeded when the steel holder is shrink-fitted onto the onto the insertion shank, resulting in some plastic deformation of the steel adjacent the bore. If the interference is not high enough, then the shrink fit may not be sufficient for the insert to be held robustly by the holder in use.

In use, a strike tip mounted on a pick tool is driven to impact a body or formation to be degraded. In road milling or mining, a plurality of picks each comprising a strike tip may be mounted onto a drum. The drum will be coupled to and driven by a vehicle, causing the drum to rotate and the picks repeatedly to strike the asphalt or rock, for example, as the drum rotates. The picks will generally be arranged so that each strike tip does not strike the body directly with the top of the apex, but somewhat obliquely to achieve a digging action in which the body is locally broken up by the strike tip. Repeated impact of the strike tip against hard material is likely to result in the abrasive wear and or fracture of the strike tip and or other parts of the pick.

Various example arrangements of the strike tip are envisaged by this disclosure, some of which are described below.

In some example arrangements, the strike structure may comprise PCD material comprising diamond grains having a mean size of at least about 15 microns. The size distribution of the diamond grains used as raw material for the PCD material may be multi-modal, and or the size distribution of the intergrown diamond grains comprised in the PCD material may be multi-modal (the latter size distribution may be measured by means of image analysis of a polished surface of the PCD material).

At least a region of the strike structure adjacent at least a strike area of the strike end may consist of PCD material containing filler material within the interstices between diamond grains, the content of the filler material being greater than 5 weight per cent of the PCD material in the region. As used herein, a strike area is an area of the strike end that may impactively engage a body or formation to be degraded when the pick tool strikes the body or formation in use. The filler material may comprise catalyst material for diamond such as cobalt, iron, nickel and or manganese, or alloys or compounds including any of these. In some arrangements, the strike area may include the apex, and may extend substantially over the entire strike end. In some arrangements, the strike structure may consist substantially of PCD material containing filler material in interstices between diamond grains, the content of the filler material being substantially uniform throughout the strike structure, or the content of filler material may vary within a range from at least 5 weight per cent to about 20 weight per cent of the PCD material.

At least part of the strike end may be generally conical and in some arrangements the strike end may have the general form of a spherically blunted cone, in which the apex is in the general form of rounded cone tip. At least part of the strike surface or a tangent to at least part of the strike surface may be inclined at an angle to a plane tangent to a peripheral side of the strike tip, the angle being at least about 35 degrees or 40 degrees and at most about 55 degrees or 45 degrees. In one particular example, the angle may be substantially 43 degrees.

In various example arrangements, the interface boundary may be substantially planar or non-planar, and may include a depression in the substrate body and or a projection from the substrate body. For example, the interface boundary may be generally dome-shaped, defined by a convex proximate end boundary of the substrate. The proximate end boundary of the substrate may have a radius of curvature in the longitudinal plane of at least about 1 mm, at least about 2 mm or at least about 5 mm, and or at most about 20 mm. In some examples, there may be a depression (concavity) in the proximate boundary end of the substrate opposite the apex of the strike structure. In example arrangements, the thickness of the strike structure between the apex and the interface boundary opposite the apex may be at least about 2.5 mm, and or at most about 10 mm. The height of the strike tip between the apex and a distal end of the strike tip substrate opposite the apex may be at least about 9 mm. In some example arrangements, the proximate end of the substrate may have a generally dome-shaped central area at least partly surrounded by a peripheral shelf, in which the domed-shaped area may include a central depression, or need not include a central depression.

The substrate may comprise cobalt-cement tungsten carbide. In some examples, the super-hard material may be formed joined to the substrate, by which is mean that the super-hard material is produced (for example sintered) in the same general step in which the super-hard structure becomes joined to the substrate. The substrate may comprise cemented tungsten carbide material including at least about 5 weight per cent and at most about 10 weight per cent or at most about 8 weight per cent binder material, which may comprise cobalt (as measured prior to subjecting the substrate to any high-pressure, high temperature condition at which the super-hard structure may be produced; the actual binder content after such treatment is likely to be somewhat lower). The cemented carbide material may have Rockwell hardness of at least about 88 HRa; transverse rupture strength of at least about 2,500 MPa; and or magnetic saturation of at least about 8 $G.cm^3/g$ and at most about 16 $G.cm^3/g$ or at most about 13 $G.cm^3/g$ and coercivity of at least about 6 kA/m and at most about 14 kA/m. Cemented carbide having relatively low binder content is likely to provide enhanced stiffness and support for the tip in use, which may help reduce the risk of fracture, and is likely to exhibit good wear resistance.

In some example arrangements, the strike structure may consist substantially of a single grade of PCD or it may comprise a plurality of PCD grades arranged in various ways, such as in layered or lamination arrangements. The strike structure may comprise a plurality of strata arranged so that adjacent strata comprise different PCD grades, adjacent strata being directly bonded to each other by inter-growth of diamond grains.

In some example arrangements, the substrate may comprise an intermediate volume and a distal volume, the intermediate volume being disposed between the strike structure and a distal volume. The intermediate volume may be greater than the volume of the strike structure and comprise an intermediate material having a mean Young's modulus at least 60% that of the super-hard material.

Certain terms and concepts as used herein are briefly explained below.

Synthetic and natural diamond, polycrystalline diamond (PCD), cubic boron nitride (cBN) and polycrystalline cBN (PCBN) material are examples of superhard materials.

As used herein, synthetic diamond, which is also called man-made diamond, is diamond material that has been manufactured. As used herein, polycrystalline diamond (PCD) material comprises an aggregation of a plurality of diamond grains, a substantial portion of which are directly inter-bonded with each other and in which the content of diamond is at least about 80 volume per cent of the material. Interstices between the diamond grains may be at least partly filled with a filler material that may comprise catalyst material for synthetic diamond, or they may be substantially empty. As used herein, a catalyst material for synthetic diamond is capable of promoting the growth of synthetic diamond grains and or the direct inter-growth of synthetic or natural diamond grains at a temperature and pressure at which synthetic or natural diamond is thermodynamically stable. Examples of catalyst materials for diamond are Fe, Ni, Co and Mn, and certain alloys including these. Bodies comprising PCD material may comprise at least a region from which catalyst material has been removed from the interstices, leaving interstitial voids between the diamond grains. As used herein, a PCD grade is a variant of PCD material characterised in terms of the volume content and or size of diamond grains, the volume content of interstitial regions between the diamond grains and composition of material that may be present within the interstitial regions. Different PCD grades may have different microstructure and different mechanical properties, such as elastic (or Young's) modulus E, modulus of elasticity, transverse rupture strength (TRS), toughness (such as so-called $K_1C$ toughness), hardness, density and coefficient of thermal expansion (CTE). Different PCD grades may also perform differently in use. For example, the wear rate and fracture resistance of different PCD grades may be different.

As used herein, PCBN material comprises grains of cubic boron nitride (cBN) dispersed within a matrix comprising metal or ceramic material.

Other examples of superhard materials include certain composite materials comprising diamond or cBN grains held together by a matrix comprising ceramic material, such as silicon carbide (SiC), or cemented carbide material, such as Co-bonded WC material (for example, as described in U.S. Pat. Nos. 5,453,105 or 6,919,040). For example, certain SiC-bonded diamond materials may comprise at least about 30 volume per cent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO2009/013713).

Where the weight or volume per cent content of a constituent of a polycrystalline or composite material is measured, it is understood that the volume of the material within which the content is measured is to be sufficiently large that the measurement is substantially representative of the bulk characteristics of the material. For example, if PCD material comprises inter-grown diamond grains and cobalt filler material disposed in interstices between the diamond grains, the content of the filler material in terms of volume or weight per cent of the PCD material should be measured over a volume of the PCD material that is at least several times the volume of the diamond grains so that the mean ratio of filler material to diamond material is a substantially true representation of that within a bulk sample of the PCD material (of the same grade).

The invention claimed is:

1. A pick tool comprising a super-hard strike tip, a steel base and a unitary cemented carbide support body comprising a head portion including an overhang portion, and a cylindrical insertion shaft having a volume of at least 15 cubic centimeters ($cm^3$), a length of at least 2 centimeters (cm), and extending from the head portion; wherein the strike tip is attached to the head portion and the base is provided with a bore into which the insertion shaft is shrink fitted, and having an external surface adjacent the bore; in which the support body comprises of cemented carbide material comprising 5 to 10 weight per cent binder material comprising cobalt, and tungsten carbide grains having a mean size of 1 to 6 microns; and the overhang portion is configured to extend radially over at least an area of the external surface a distance of more than 5 per cent of the mean diameter of the bore, operative to shield the area from wear when in use.

2. A pick tool as claimed in claim 1, in which the base comprises a shank configured for coupling the pick tool non-rotatably to a tool carrier drum.

3. A pick tool as claimed in claim 1, for road milling or mining.

4. A pick tool as claimed in claim 1, in which the super-hard material is polycrystalline diamond (PCD) material.

5. A pick tool as claimed in claim 1, in which the strike tip comprises a strike structure joined to a substrate at an interface boundary, the strike structure comprising super-hard material and the substrate comprising carbide material; the strike structure having a strike end opposite the interface boundary, the strike end including a rounded apex having a radius of curvature in a longitudinal plane of greater than 3.176 and at most 6 mm.

6. A pick tool as claimed in claim 1, in which the support body comprises cemented tungsten carbide having Rockwell hardness of at least 90 HRa, transverse rupture strength of at least 2,500 MPa, magnetic saturation of at least 7 $G.cm^3/g$ and at most 11 $G.cm^3/g$, and coercivity of at least 9 kA/m and at most 14 kA/m.

7. An assembly comprising a pick tool as claimed in claim 1 and a fixture attached to a drum for road milling or mining, in which the fixture and pick tool are cooperatively configured to be capable of being coupled in such a way that the pick tool is prevented from rotating with respect to the fixture.

* * * * *